US005665503A

United States Patent [19]

Tsunoda et al.

[11] Patent Number: 5,665,503

[45] Date of Patent: Sep. 9, 1997

[54] POSITIVE CHARGE TYPE ORGANIC PHOTOCONDUCTIVE LAYER

[75] Inventors: Sei Tsunoda; Toshio Kobayashi, both of Amagasaki; Shigeo Tsuda, Kamakura; Kikuo Hayama; Hiromi Yamada, both of Amagasaki, all of Japan

[73] Assignee: Mitsubishi Denki Kabushiki Kaisha, Tokyo, Japan

[21] Appl. No.: 289,996

[22] Filed: Aug. 12, 1994

Related U.S. Application Data

[63] Continuation of Ser. No. 925,606, Aug. 4, 1992, abandoned.

[30] Foreign Application Priority Data

Sep. 12, 1991 [JP] Japan ..... 3-232875

[51] Int. Cl.[6] ..... G03G 15/04

[52] U.S. Cl. ..... 430/66; 430/67

[58] Field of Search ..... 430/66, 67

[56] References Cited

U.S. PATENT DOCUMENTS

| | | | |
|---|---|---|---|
| 3,816,118 | 6/1974 | Byrne | 96/1.5 |
| 4,362,799 | 12/1982 | Kondo et al. | 430/67 |
| 4,547,447 | 10/1985 | Ueda | 430/78 |
| 4,842,971 | 6/1989 | Sugaiwa et al. | 430/64 |
| 5,069,992 | 12/1991 | Tachikawa et al. | 430/49 |
| 5,120,628 | 6/1992 | Mammino et al. | 430/59 |

FOREIGN PATENT DOCUMENTS 59-135477 8/1984 Japan .

OTHER PUBLICATIONS

English Translation of JP 59–135477.

English Translation of JP 59–135476.

Diamond, Arthur S. Handbook of Imaging Materials, pp. 411–415. 1991

Borsenberger et al. "Organic Photoreceptors For Imaging Systems", (1993) Chapter 11–Photoreceptors, pp. 338–349. 1993

Database WPIL Section Ch, Week 8437 Minolta Aug 3, 1984 Abstract.

Database WPIL Section Ch, Week 8442 Minolta Sep. 7, 1984 Abstract.

Database WPIL Section Ch, Week 9130 Mita Jun. 13, 1991 Abstract.

IBM Technical Disclosure Bulletin, vol. 33 Jun. 1, 1990 "Photoconductor Overcoat".

*Primary Examiner*—George F. Lesmes

*Assistant Examiner*—Laura Weiner

*Attorney, Agent, or Firm*—Wolf, Greenfield & Sacks P.C.

[57] ABSTRACT

A positive charge type organic photoconductor in which the surface of the photoconductor having a film thickness of from 10 to 30 μm and containing at least from 15 to 40% by weight of a phthalocyanine type photoconductive compound in a resin binder, is treated with a reactive monomer or oligomer capable of extinguishing ionic active and radical active parts.

7 Claims, 10 Drawing Sheets

POSITIVE CHARGE TYPE ORGANIC PHOTOCONDUCTIVE LAYER

This application is a file wrapper continuation of application Ser. No. 07/925606 filed Aug. 4, 1992, now abandoned.

The present invention relates to a photoconductor used for an electrophotographic copying machine or printer.

An electrophotographic copying machine or printer is repeatedly used many times by electrically charging the surface of a photoconductor, forming an electrostatic latent image by exposing to light, developing the electrostatic latent image with a toner to form a visible image, transferring the visible toner image onto a paper or the like, fixing the transferred toner image thereon, removing electricity from the photoconductor and cleaning the surface of the photoconductor.

Thus, the electrophotographic photoconductor is required to have satisfactory electrophotographic properties including good charging properties and photosensitivity as well as satisfactorily small dark decay, and is also required to have satisfactory physical properties including good printing resistance, abrasion resistance and moisture resistance as well as good chemical resistance to ozone or the like generated during corona discharging. It is also required that the above-mentioned electrophotographic properties do not substantially change as a lapse of time during repeated use.

Heretofore, inorganic photoconductors such as selenium, zinc oxide and cadmium sulfide were used as an electrophotographic photoconductive material. Recently, however, many organic photoconductors have often been used to solve the toxicity problem of the inorganic material, or to satisfy a high speed copying machine or printer which requires a light source producing a high luminance, or to comply with a shift of a photosensitive wavelength zone to a long-wavelength zone due to the use of a semiconductor laser or LED. Also, a positive charge type organic photoconductor which can control the generation of ozone during corona discharging to a much lower level, has attracted a good deal of public attention.

The merit of using a phthalocyanine type photoconductive material as the positive charge type organic photoconductor is well known from U.S. Pat. No. 3,816,118 and Japanese Examined Patent Publication No. 4338/1974. That is, the phthalocyanine type photoconductive compound generally has a high light-absorbance and excellent heat resistance, chemical resistance and light resistance, and also has a high photoconductivity by light exposure, i.e. excellent in the efficiency of generating an electron.hole pair.

A positive charge type photoconductor using a phthalocyanine type compound is generally composed of an undercoat layer on an aluminum drum and a layer having the phthalocyanine type compound powder dispersed in resin coated thereon. Thus, the basic structure is very simple.

The conventional positive charge type organic photoconductor using a phthalocyanine type photoconductive compound has such a structure as mentioned above, and the amount of ozone generated is small since the photoconductor is charged with positive corona, but the conventional photoconductor has a defect of being very poor in ozone resistance. Consequently, the life of the photoconductor is remarkably reduced by repeated use and by use under such conditions of high temperature and moisture as to highly generate ozone, and it is therefore necessary for practically using the conventional photoconductor to conduct aeration around the photoconductor in such a manner as to prevent the exposure or attack of ozone.

The present invention has been made to completely solve the above mentioned ozone problems related to the conventional photoconductor.

As a method for solving the above mentioned problems, it is easily conceived to provide an overcoat layer on a photoconductor in such a manner as to prevent the photoconductor from directly exposed to ozone atmosphere. It is disclosed in U.S. Pat. No. 3,816,118 to provide an overcoat layer, but its main object is to provide such a physical protective layer for a photoconductor as to improve printing resistance, wear resistance and moisture resistance. The present inventors have recognized that such an overcoat layer is effective in this respect, but have recognized also that such an overcoat layer brings disadvantages on the other hand. That is, the photosensitivity of the photoconductor is lowered by the presence of the overcoat layer, and the photosensitivity varies as a lapse of time in proportion as the overcoat layer is mechanically abraded according to a printing resistance test. Moreover, it was discovered that the above-mentioned overcoat layer was not always effective for blocking ozone. That is, it was experimentally observed that ozone permeated through the overcoat layer to adversely affect on the properties of the photosensitive layer.

Accordingly, the present inventors have fully studied the mechanism of the degradation of a photoconductor by ozone, and have found that the chemically defective part of the photoconductor is selectively attacked by ozone.

The chemically defective parts of the photoconductor are defined to include a structural defect of a phthalocyanine type compound used as a photoconductive material, e.g. the state in which one atom of hydrogen is omitted, and a structural defect of a binder resin. These defective parts generally constitute long lived reactive or radical species, which are stable in normal state. However, these defective parts tend to be decomposed easily by highly reactive ozone. If a photoconductor having no defect can be prepared, the ozone problem can be solved, but it is not practical for industrial use in respect of economics to prepare a photoconductor from a highly pure material having no defect.

The present inventors have conducted the above-mentioned basic experiments and analyzed their data, and as this result, the present inventors have completed the present invention.

A positive charge type organic photoconductor of the present invention is characterized by treating, i.e. coating surface of the photoconductor having a film thickness of from 10 to 30 μm and containing at least 15 to 40% by weight of a phthalocyanine type photoconductive compound with a reactive monomer or oligomer capable of quenching a reactive ionic or radical species.

Figure 1:
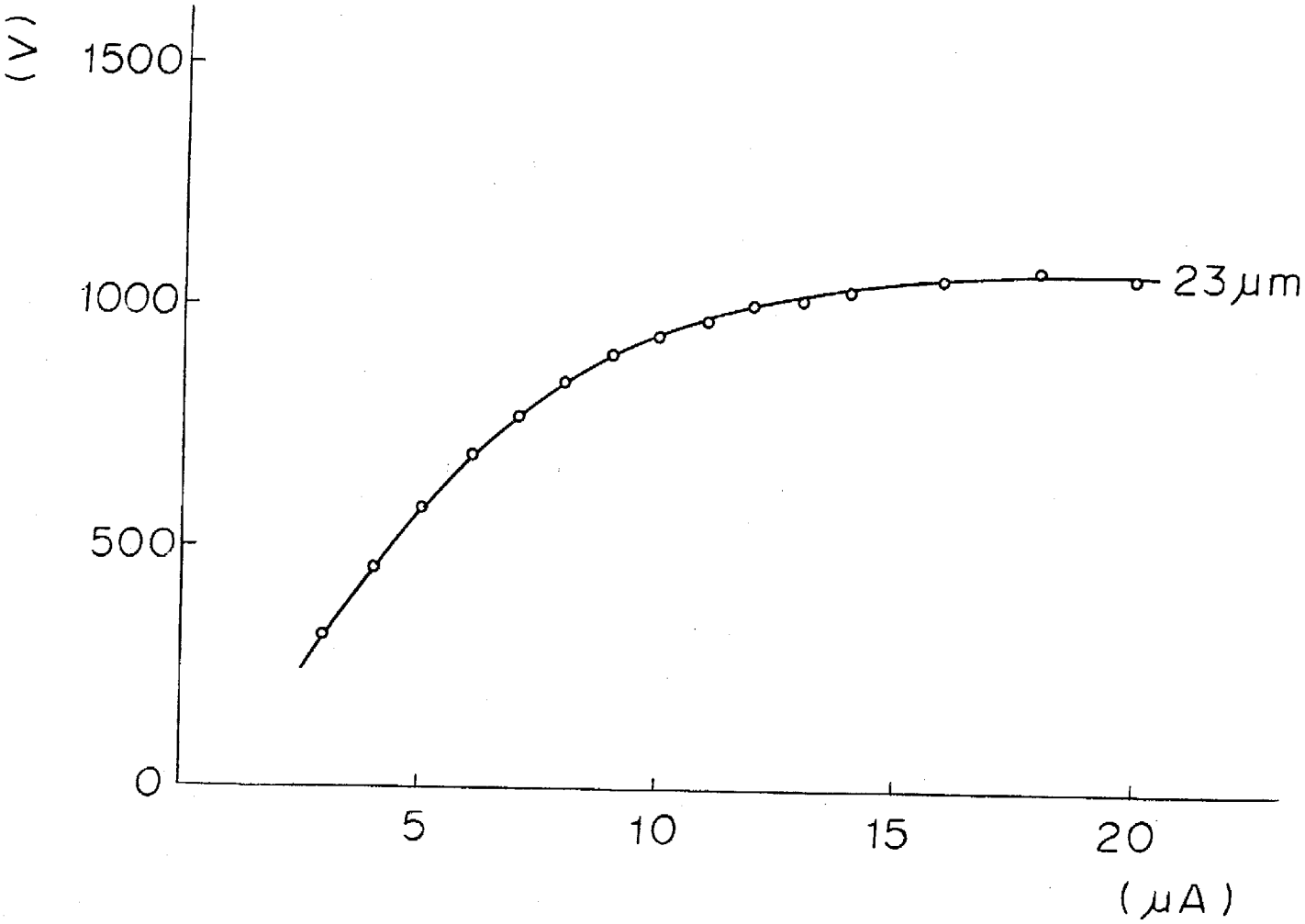
FIG. 1 is a graph plotting charging voltage as a function of corona electric current, illustrating the charging property according to one embodiment of the present invention.
Figure 2:
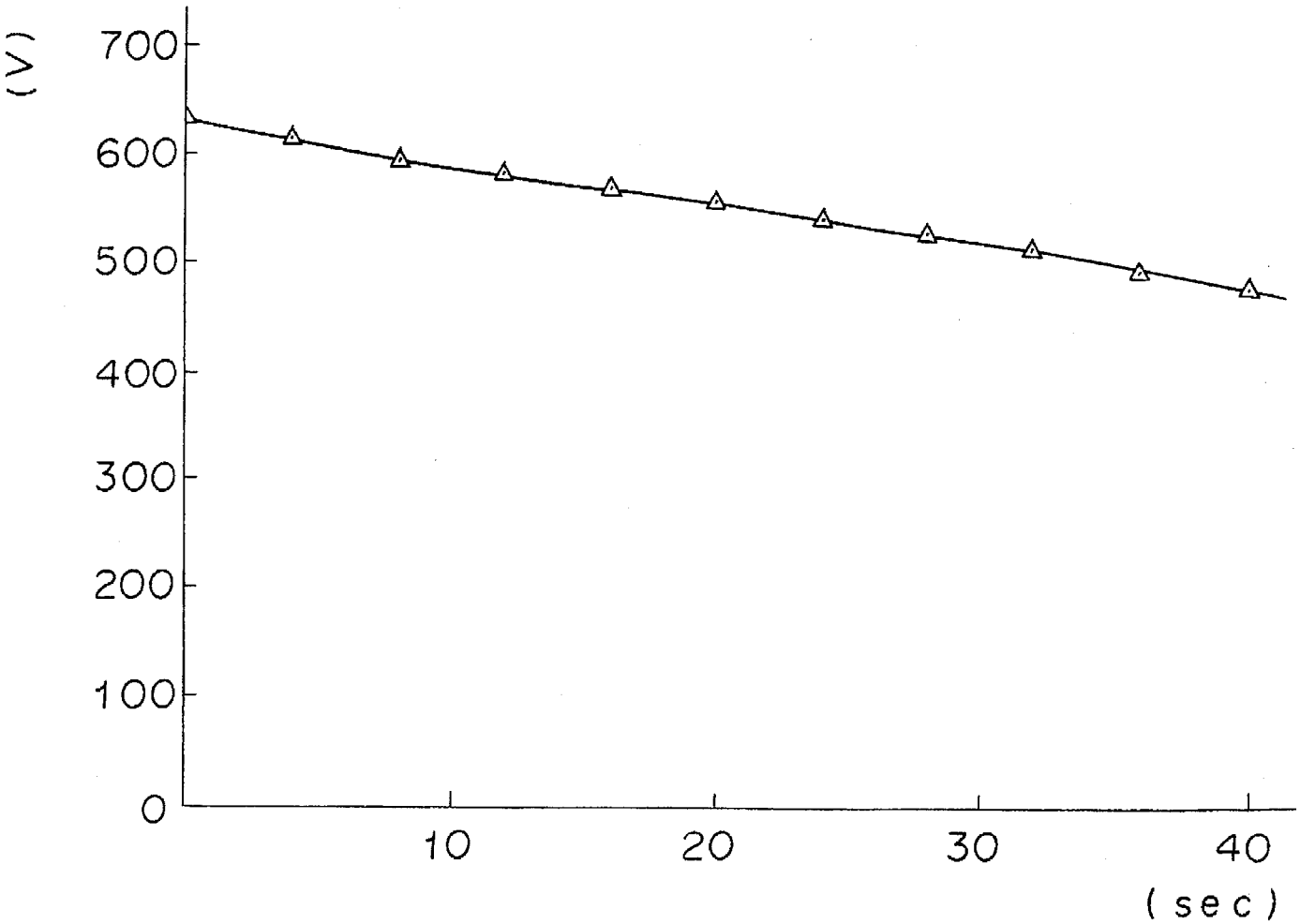
FIG. 2 is a graph plotting surface potential as a function of dark decay time, illustrating charge-retaining ability according to one embodiment of the present invention.
Figure 3:
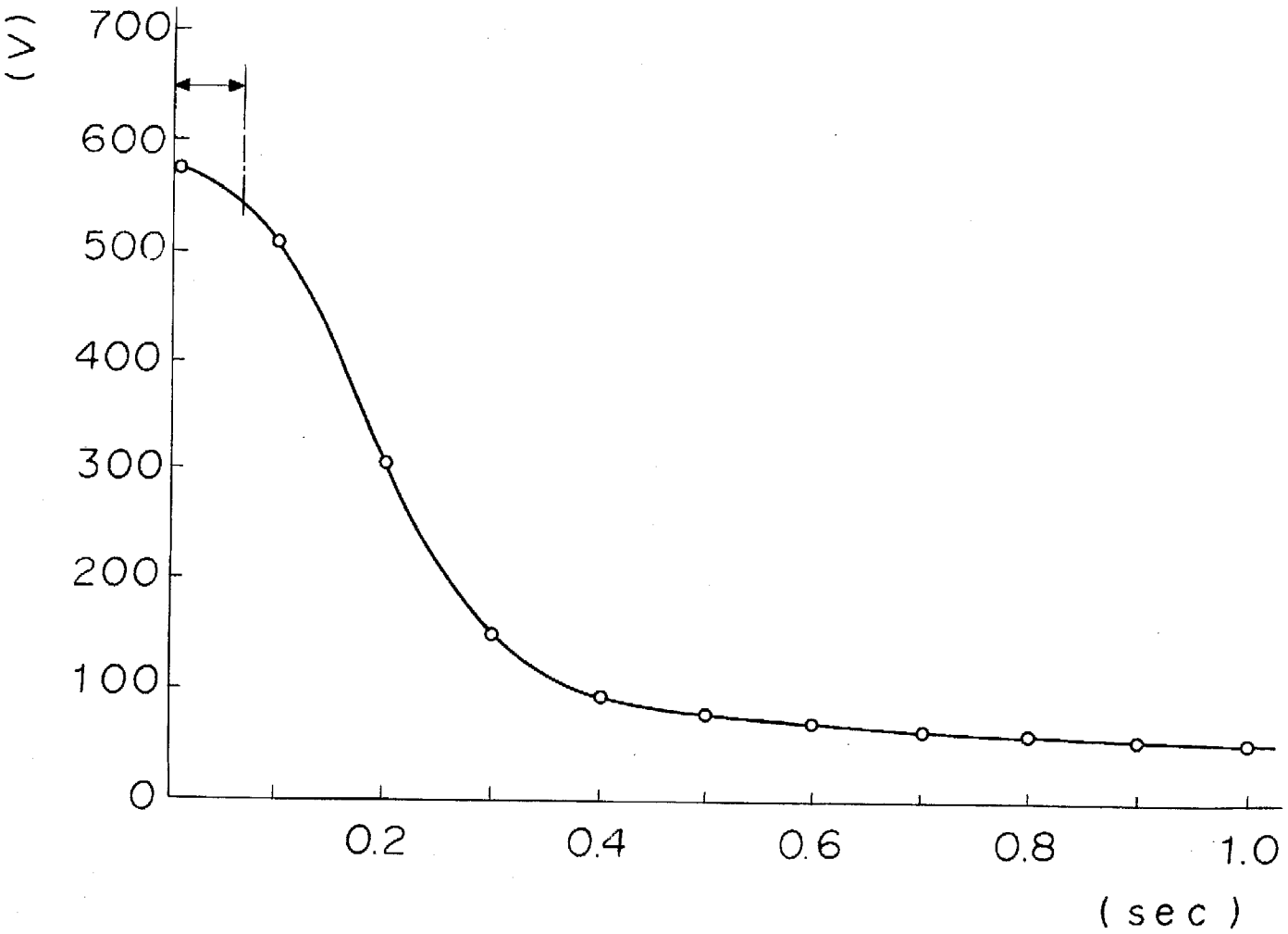
FIG. 3 is a graph plotting surface potential as a function of time from the initiation of exposure, illustrating response speed according to one embodiment of the present invention.
Figure 4:
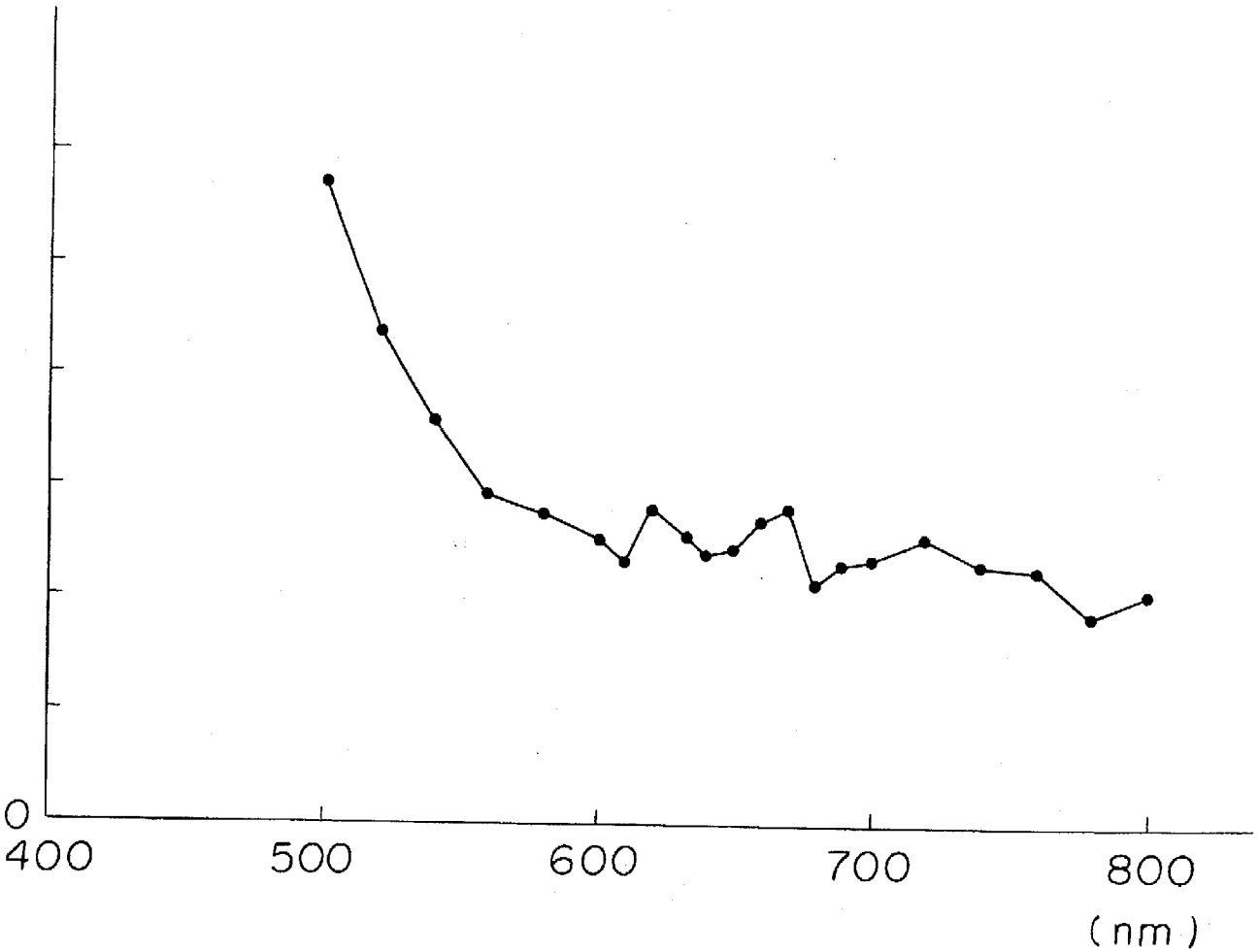
FIG. 4 is a graph plotting energy, in absorbance units, as a function of wavelength, illustrating spectrum sensitivity according to one embodiment of the present invention.
Figure 5:
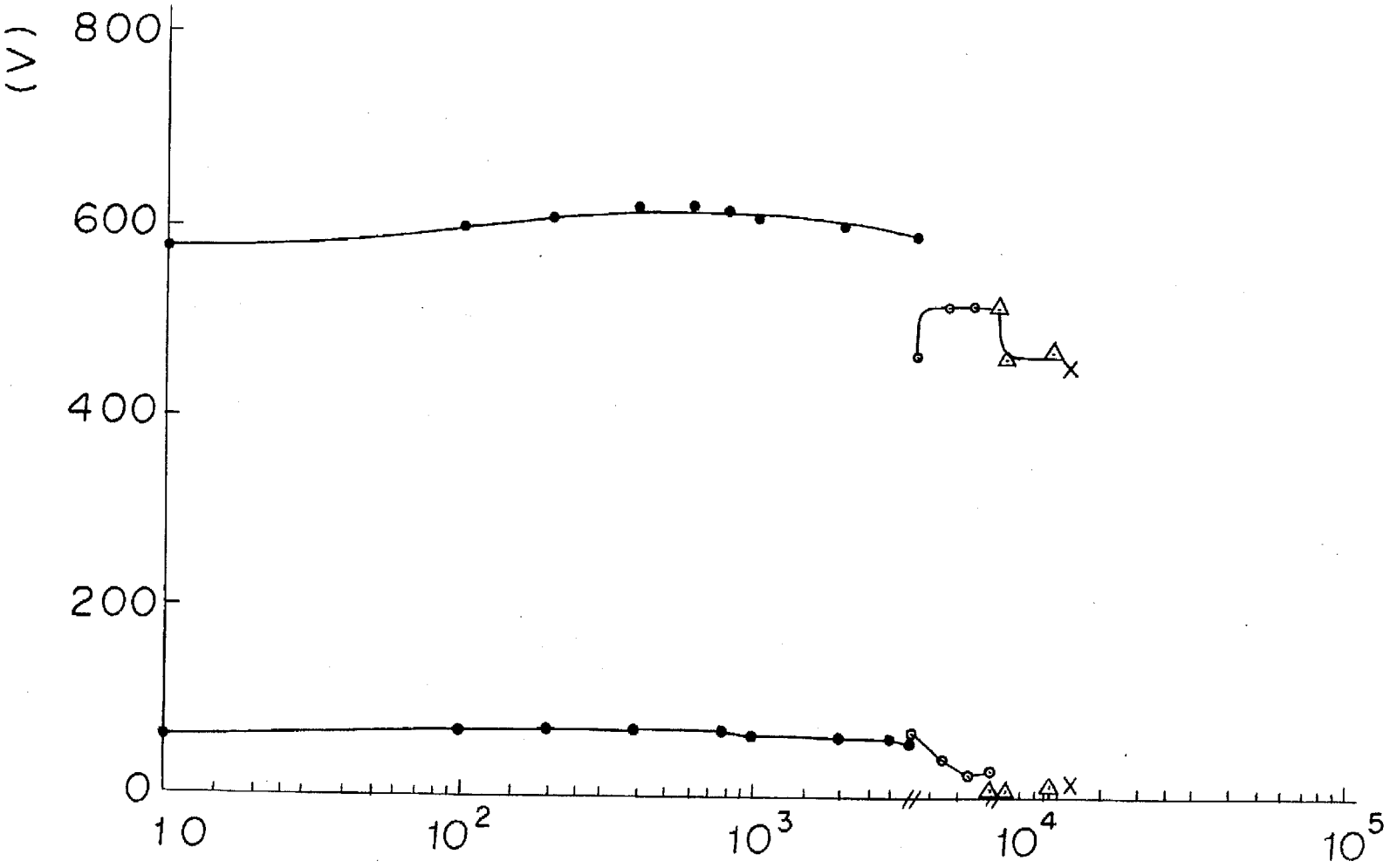
FIG. 5 is a graph plotting electric potential as a function of repeating time, illustrating repeated charging property according to one embodiment of the present invention.
Figure 6:
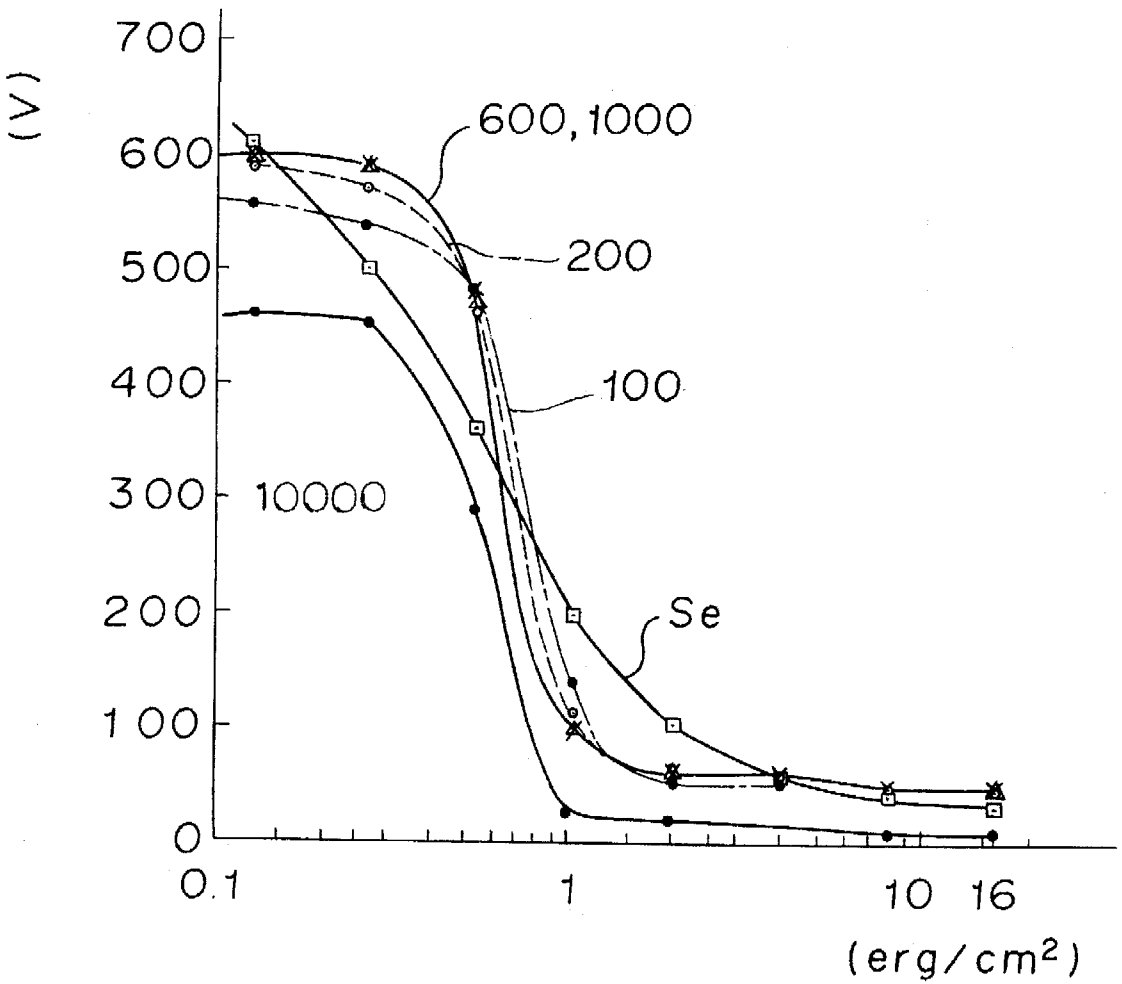
FIG. 6 is a graph plotting electric potential as a function of erg/cm$^2$, illustrating light decay property after repeating test according to one embodiment of the present invention.
Figure 7:
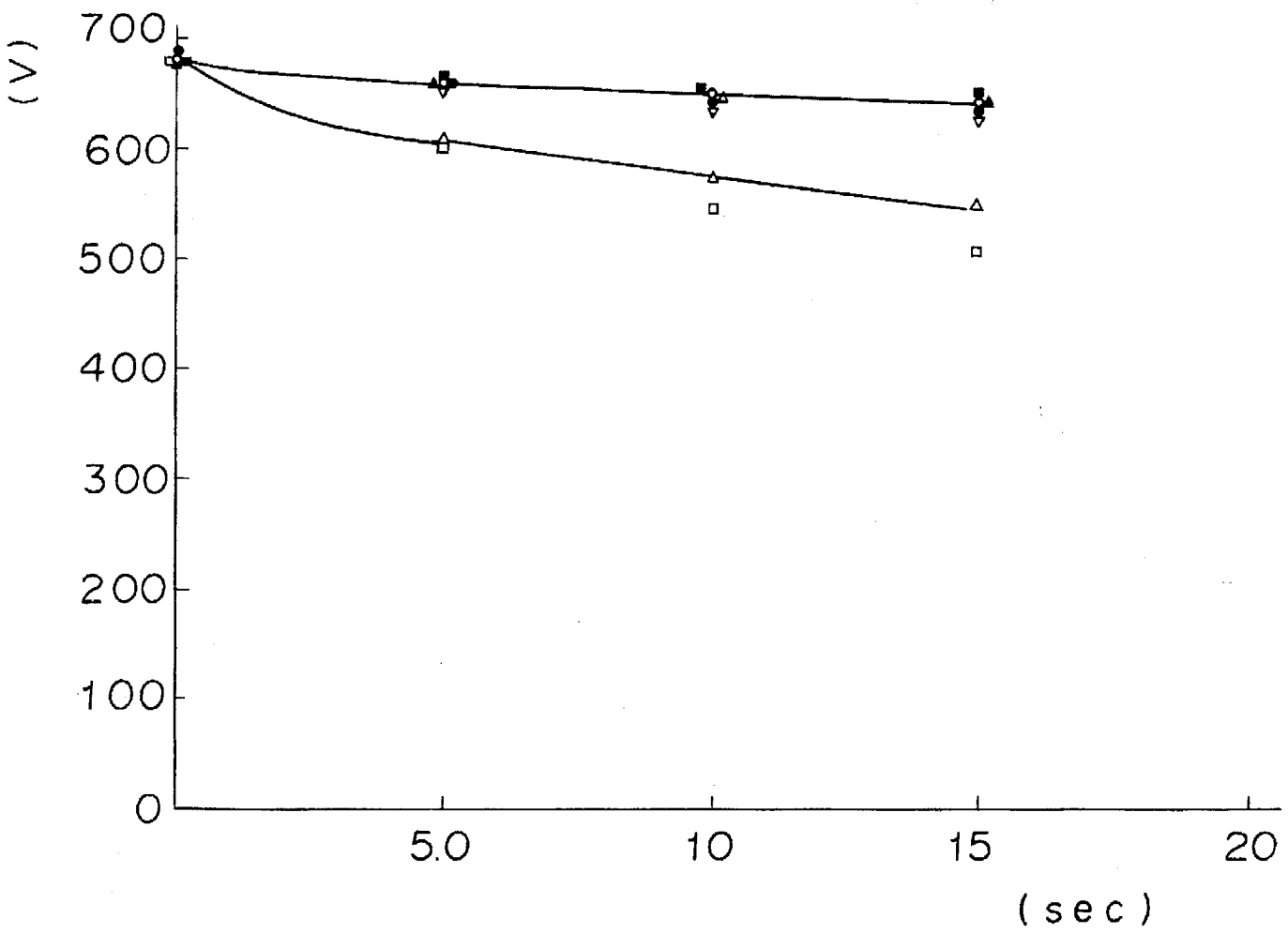
FIG. 7 is a graph plotting surface potential as a function of time, illustrating environmental stability of dark decay property according to one embodiment of the present invention.
Figure 8:
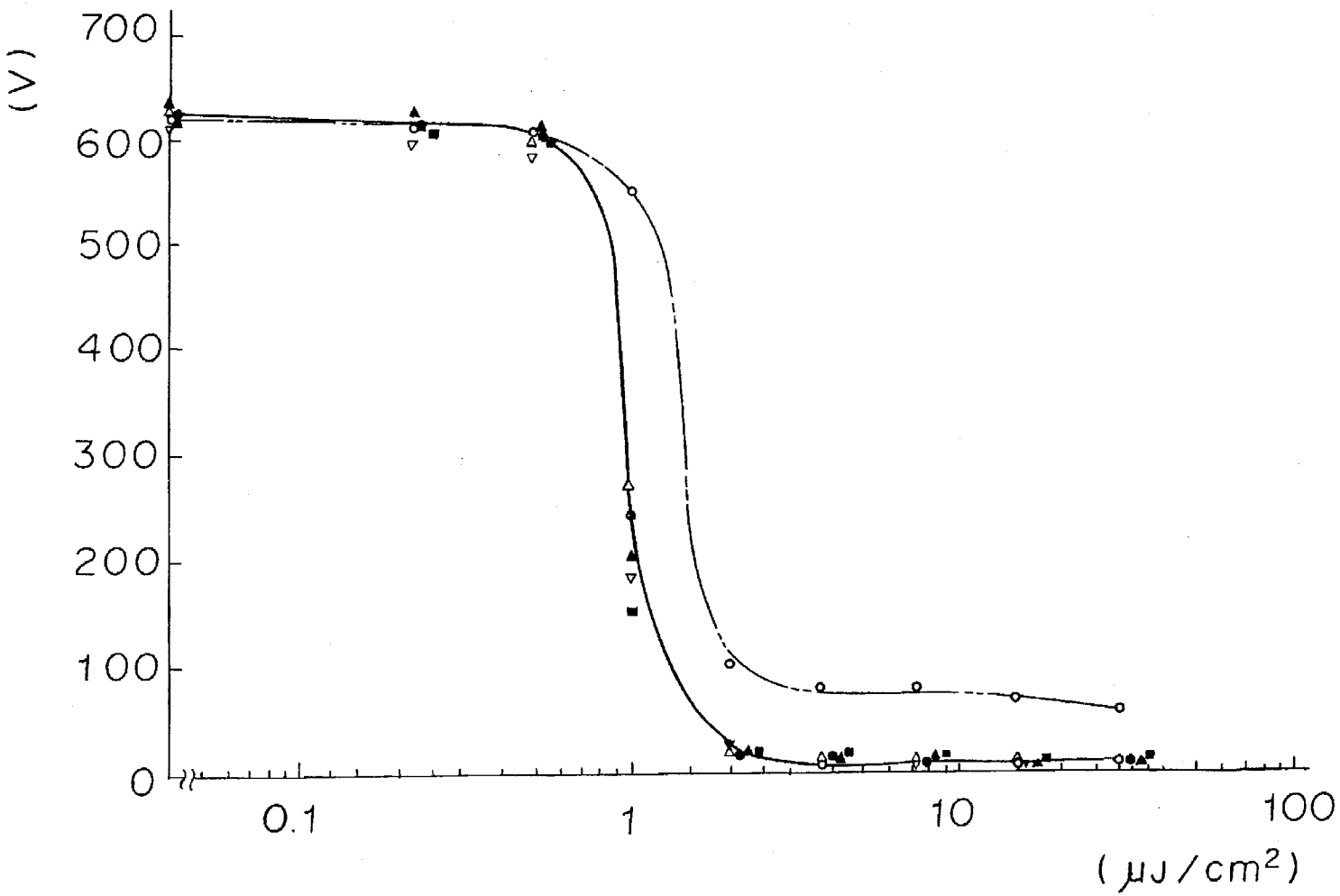
FIG. 8 is a graph plotting surface potential as a function of the amount of exposure, illustrating environmental stability of light decay property according to one embodiment of the present invention.

Examples of phthalocyanine type photoconductive compounds which can be used in the present invention include those disclosed in the above-mentioned Japanese Examined Patent Publication No. 4338/1974. On account of the above-mentioned reasons, a phthalocyanine type material is preferably used in the positive charge type photoconductor of the present invention.

Among the phthalocyanine type photoconductive compounds, $\chi$ type crystal of a metal-free phthalocyanine is preferably used. In the case of a metallophthalocyanine, the electrically neutral state is maintained ideally by coordinating phthalocyanine with metal, but a defective part is actually liable to occur and the defective part is easily oxidized by ozone. On the other hand, in the case of the metal-free phthalocyanine, only a small hydrogen atom is coordinated, and coordination defects hardly occur.

The particle size of the phthalocyanine type photoconductive compound is preferably small so as to be satisfactorily dispersible.

In the positive charge type photoconductor of the present invention, the above-mentioned phthalocyanine type compound is used generally in such a state as to be dispersed in a binder resin, and a binder resin having a good charge-retaining rate, which is a good dispersion medium for phthalocyanine, is used as it is in the present invention. However, with respect to ozone resistance, a binder resin which does not have reactive ionic or radical species and which is insoluble or unswellable during the following treatment with a reactive monomer or oligomer, is preferably used. Preferable examples include thermosetting resins such as acrylic resin, polyester resin, urethane resin, butyral resin, and resins prepared by thermosetting these resins with amino resin, isocyanate resin or the like.

It is necessary that the amount of the phthalocyanine type photoconductive compound contained in the photoconductor of the present invention should be from 15 to 40% by weight. This is the essential condition for enabling the photoconductor to work as a positive charge type photoconductor. If the amount of the photoconductive compound contained in the photoconductor is less than the above-mentioned range, the photosensitivity is remarkably lowered. On the other hand, if the amount of the photoconductive compound is larger than the above-mentioned range, the bulk resistance of the photoconductor is lowered and the charge-retaining ability is lowered. Thus, in order to obtain a good balance between the photosensitivity and the charge-retaining ability, it is preferable to use the photoconductive compound in an amount of from 25 to 35% by weight.

A film thickness of the photoconductor should be in the range of from 10 to 30 μm. If the film thickness is thinner than this range, pinholes are liable to occur and mechanical properties such as printing resistance are remarkably lowered. On the other hand, if the film thickness is thicker than this range, a light response speed is lowered, and the amount of the expensive photoconductive material must be increased, thus being unpreferable from an economical viewpoint. Accordingly, the most preferable film thickness ranges from 15 to 25 μm in view of the charge-retaining ability and the light response speed.

The photoconductor having the above mentioned film thickness is formed by mixing a phthalocyanine type photoconductive material with a binder resin and a solvent, dispersing the mixture by means of a paint shaker, a ballmill, a dispersing machine or the like, and coating the resultant dispersion on an undercoat layer provided on the surface of an aluminum drum by a dipping method, a spray method or the like.

There are necessarily present reactive ionic or radical species which are closely related ozone on the surface of the photoconductor containing the above,mentioned phthalocyanine type photoconductive compound. Therefore, the positive charge type organic photoconductor of the present invention is advantageously treated, i.e. coated, with a reactive monomer or polymeric species capable of quenching reactive ionic or radical species of the photoconductor. Reactive ionic or radical species are defined as chemical groups including coordinatively unsaturated sites of phthalocyanine, and radicals of a binder resin such as aryl radicals. Such species are stable under normal conditions as mentioned above, but in the presence of a highly reactive molecule (a strong oxidizer) such as ozone, may be decomposed. According to the present invention, these reactive species are quenched in advance by treatment with the reactive substance.

Examples of the reactive monomer or oligomer, having the above-mentioned effect include compounds which may be polymerized by radical reaction as disclosed in Japanese Unexamined Patent Publications Nos. 139832/1976 and 75235/1978, and epoxy resins which may be polymerized by ion polymerization as disclosed in Japanese Unexamined Patent Publication No. 83966/1979. Among the above-mentioned reactive monomers or oligmers, diglycidylether type epoxy resins of bisphenol A or bisphenol F which have been satisfactorily used as electrical insulating material, are preferably used in the present invention from the viewpoints of ozone resistance, charge-retaining ability and photosensitivity, and as a curing agent, a highly reactive (first-curing) amine type compound is preferably used. It is naturally preferable to use these compounds in a stoichiometric ratio.

A method for treating the photoconductive layer with the reactive monomer or oligomer is not specially limited so long as it quenches the reactive species as mentioned above. For example, one method comprises dissolving the above mentioned reactive monomer or oligomer in an organic solvent, dipping the photoconductor into the low viscosity solution thus prepared, drying the solvent and then reacting. It is preferable to use a solution having a low concentration of not higher than 5% in such a manner that the same inconveniences as in the above-mentioned conventional overcoat layer will not occur. It is also preferable not to prolong the dipping time so long in order that the reactive monomer or oligomer will not impregnate into the photoconductive layer to prevent the photosensitivity from lowering. It is also preferable to use such an organic solvent as not to swell or dissolve the binder resin of the photoconductive layer.

The present invention is further illustrated in more details by the following Examples but should not be limited thereto.

EXAMPLES 1 TO 14

A substrate for a photoconductive layer was prepared by dipping a polished aluminum plate in a methanol solution of a polyamide resin ("CM-8000" manufactured by Toray K.K.) to form an undercoat layer and drying. The average film thickness was about 0.5 μm.

Mixture solutions were prepared by using the following phthalocyanine type photoconductive compounds and binder resins in such a manner as shown in Table 1 and using cyclohexanone, methyl ethyl ketone, toluene and xylene respectively alone or in a mixture as a dispersion solvent depending on the solubility of the binder resin employed.

Phthalocyanine type photoconductive compounds:

(A) χ type crystal of metal-free phthalocyanine ("8120B" manufactured by Dainihon ink Kagaku Kogyo K.K.), (B) ε type crystal of copper phthalocyanine ("EP-101" manufactured by Dainihon Ink Kagaku Kogyo K.K.), (C) β type crystal of copper phthalocyanine ("4920" manufactured by Dainichi Seika Kogyo K.K.), and (D) α type crystal of copper phthalocyanine ("B" manufactured by Toyo Ink Seizo K.K.).

Binder resins:

(a) Epoxy resin ("Epikote 828" and "Epomate B-002" (50 phr) manufactured by Yuka Shell Epoxy K.K.), (b) Polycarbonate resin ("PCZ-4000" manufactured by Mitsubishi Gas Kagaku K.K.), (c) Melamine/acrylic resin blend ("11-30" manufactured by Fuji Shikiso K.K.), (d) Styrene-acrylic resin ("CPR-100" manufactured by Mitsui Toatsu Kagaku K.K.), (e) Polyester/melamine resin blend (127/32 weight ratio blend of "P-645" (manufactured by Mitsui Toatsu Kagaku K.K.)/"Uban20-HS" (manufactured by Mitsui Toatsu Kagaku K.K.)), (f) Silicone resin (100/10 weight ratio blend of "KE-108" manufactured by Shinetsu Silicone K.K.)/"CAT-108" manufactured by Shinetsu Silicone K.K.)), (g) Polyurethane resin ("8-30" manufactured by Fuji Shikiso K.K.), and (h) Vinylchloride-vinylacetate copolymer ("9-30" manufactured by Fuji Shikiso K.K.).

The above mixture solutions were prepared by blending a phthalocyanine type photoconductive compound in an amount of from 25 to 35% by weight, adjusting to give a solid content of from 15 to 30% by weight and dispersing the resultant mixture by a paint shaker (manufactured by Reddevil Company) from 15 minutes to 2 hours.

The mixture solution thus prepared was coated on the above prepared substrate having the undercoat layer by dipping method to form a photoconductive layer. The coating was conducted by dipping the substrate in the mixture solution for 2 minutes at a pulling up rate of not higher than 100 cm/minute, preferably from 15 to 20 cm/minute.

The samples thus coated were dried at room temperature for overnight, and were heated in an oven at 150° C. for 4 hours to obtain semi-photoconductor test pieces Nos. 1 to 14. The compositions and the film thicknesses of the semi-photoconductors thus obtained are shown in Table 1.

Electrophotographic properties including ozone resistance of the semi-photoconductor test pieces Nos. 1 to 14 thus obtained were evaluated by measuring initial charge potentials $V_0$ (V), charge potentials $V_{30}$ (V) after continuously corona charging for 30 seconds and charge potentials $V_{90}$ (V) after continuously corona charging for additional 1 minute of the semi-photoconductors charged at a constant current of +10 μA by means of "EPA-8100" manufactured by Kawaguchi Denki Seisakusho. If a semi-photoconductor is excellent in ozone resistance, the charge potential does not vary between the $V_0$ value and the $V_{90}$ value, but if a semi-photoconductor is poor in ozone resistance, the $V_{90}$ value is largely lowered relative to the $V_0$ value. The measurement results are shown in Table 2.

Thereafter, 50 phr of amine ("Epomate B-002" manufactured by Yuka Shell Epoxy K.K.) was added to diglycidyl ether type epoxy resin of bisphenol F ("Epikote 815" manufactured by Yuka Shell Epoxy K.K.), and the resultant mixture was dissolved in ethanol to prepare a 0.5% solution. Epomate B-002 has the following structural formula:

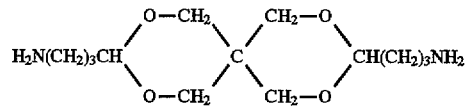

The above prepared semi-photoconductor test pieces Nos. 1 to 14 were dipped in this solution for 1 minute, and were then dried in air for 2 hours and were heated in an oven at 120° C. for 2 hours to prepare photoconductor test pieces. The increase in the film thickness of every test piece by this treatment was not more than 1 μm. The electrophotographic properties including ozone resistance of the photoconductor test pieces (Examples 1 to 14) thus obtained were measured in the same manner as above, and the results are shown in Table 3.

As evident from Table 3, all of the photoconductors of Examples 1 to 14 of the present invention were excellent in ozone resistance. Thus, the ozone resistance of a photoconductor was greatly improved by treating with epoxy resin (reactive oligomer).

TABLE 1

| Semi-photosensitive material test piece No. | Photoconductive compound | Binder resin | Content of photoconductive compound (%)*1 | Film thickness (μm) |
|---|---|---|---|---|
| 1 | (A) | (d) | 30 | 20 |
| 2 | (B) | (d) | 30 | 20 |
| 3 | (C) | (d) | 30 | 20 |
| 4 | (D) | (d) | 30 | 20 |
| 5 | (A) | (b) | 30 | 20 |
| 6 | (A) | (c) | 30 | 20 |
| 7 | (A) | (e) | 30 | 20 |
| 8 | (A) | (f) | 30 | 20 |
| 9 | (A) | (g) | 30 | 20 |
| 10 | (A) | (h) | 30 | 20 |
| 11 | (A) | (e) | 25 | 20 |
| 12 | (A) | (e) | 35 | 20 |
| 13 | (A) | (e) | 30 | 15 |
| 14 | (A) | (e) | 30 | 25 |

Note: *1: Content to the total amount

TABLE 2

| Semi-photosensitive material test piece | | | | Measurement temperature and moisture | |
|---|---|---|---|---|---|
| No. | $V_0$ (V) | $V_{30}$ (V) | $V_{90}$ (V) | (°C.) | (%) |
| 1 | 566 | 422 | 363 | 19.0 | 40 |
| 2 | 610 | 380 | 250 | 19.0 | 40 |
| 3 | 670 | 370 | 210 | 19.0 | 40 |
| 4 | 610 | 300 | 170 | 19.0 | 40 |
| 5 | 383 | 218 | 193 | 19.6 | 43 |
| 6 | 765 | 420 | 365 | 20.0 | 38 |

TABLE 2-continued

| Semi-photosensitive material test piece No. | $V_0$ (V) | $V_{30}$ (V) | $V_{90}$ (V) | Measurement temperature and moisture (°C.) | (%) |
|---|---|---|---|---|---|
| 7 | 600 | 450 | 340 | 14.2 | 45 |
| 8 | 511 | 31 | 24 | 19.7 | 43 |
| 9 | 543 | 186 | 78 | 19.7 | 42 |
| 10 | 254 | 72 | 48 | 18.6 | 51 |
| 11 | 675 | 408 | 373 | 20.0 | 38 |
| 12 | 408 | 227 | 180 | 20.0 | 38 |
| 13 | 560 | 430 | 300 | 21.5 | 42 |
| 14 | 630 | 480 | 390 | 21.5 | 42 |

TABLE 3

| Example No. | Semi-photosensitive material test piece No. | $V_0$ (V) | $V_{30}$ (V) | $V_{90}$ (V) | Measurement temperature and moisture (°C.) | (%) |
|---|---|---|---|---|---|---|
| 1 | 1 | 561 | 525 | 511 | 19.0 | 40 |
| 2 | 2 | 619 | 601 | 583 | 19.0 | 40 |
| 3 | 3 | 706 | 675 | 652 | 19.0 | 40 |
| 4 | 4 | 618 | 596 | 581 | 19.0 | 40 |
| 5 | 5 | 400 | 390 | 390 | 19.6 | 43 |
| 6 | 6 | 759 | 698 | 671 | 20.0 | 38 |
| 7 | 7 | 650 | 620 | 540 | 14.2 | 45 |
| 8 | 8 | 525 | 453 | 382 | 19.7 | 43 |
| 9 | 9 | 545 | 500 | 460 | 19.7 | 42 |
| 10 | 10 | 271 | 270 | 270 | 18.6 | 51 |
| 11 | 11 | 673 | 634 | 610 | 20.0 | 38 |
| 12 | 12 | 415 | 410 | 410 | 20.0 | 38 |
| 13 | 13 | 564 | 531 | 526 | 21.5 | 42 |
| 14 | 14 | 655 | 620 | 597 | 21.5 | 42 |

EXAMPLES 15 TO 16

The photoconductor of Example 15 or the photoconductor of Example 16 was prepared by dipping the above prepared semi-photoconductor test piece No. 7 as shown in Table 1 in the solution (Example 15) comprising 9.6 g of triethylene glycol dimethacrylate, 0.4 g of dicumylperoxide and 1.0 l of ethanol or in the solution (Example 16) comprising 9.6 g of bis(acryloxydiethoxyphenyl)propane, 0.4 g of dicumylperoxide and 1.0 l of ethanol for 1 minute, drying in air for 2 hours and heating in an oven at 130° C. for 2 hours. The photoconductor test pieces thus obtained were evaluated with regard to the electrophotographic properties including ozone resistance in the same manner as mentioned above, and the results are shown in Table 4.

EXAMPLES 17 TO 18

Photoconductor test pieces were prepared in the same manner as in Example 7, except that bisphenol F type epoxy resin was replaced by bisphenol A type epoxy resin ("Epicote 828" manufactured by Yuka Shell Epoxy K.K.) (Example 17) or by phenol-novolak type epoxy resin ("Epikote 152" manufactured by Yuka Shell Epoxy K.K.) (Example 18), and were evaluated with regard to the electrophotographic properties in the same manner as above. The results are shown in Table 4.

COMPARATIVE EXAMPLES 1 TO 3

As Comparative Examples, comparative test pieces were prepared by forming an overcoat layer of polyester ("P-645" manufactured by Mitsui Toatsu Kagaku K.K.) (Comparative Example 1), butyral resin ("Esrec B" manufactured by Sekisui Kagaku Kogyo K.K.) (Comparative Example 2) or polycarbonate ("PCZ-4000" manufactured by Mitsubishi Gas Kagaku K.K.) (Comparative Example 3) on the surface of the above prepared semi-photoconductor test piece No. 7 by usual coating method without using the reactive monomer or oligomer, and were evaluated with regard to the electrophotographic properties in the same manner as above. The results are shown in Table 4.

As evident from the results of Table 4, the photoconductor prepared by treating with the reactive monomer or oligomer capable of extinguishing the ionic active and radical active parts are excellent in ozone resistance. On the other hand, as evident from Comparative Examples 1 to 3, the conventional overcoat layers do not achieve the effect for improving ozone resistance.

TABLE 4

| Example No. | $V_0$ (V) | $V_{30}$ (V) | $V_{90}$ (V) | Measurement temperature and moisture (°C.) | (%) |
|---|---|---|---|---|---|
| 15 | 670 | 630 | 520 | 18.7 | 42 |
| 16 | 690 | 640 | 540 | 18.7 | 42 |
| 17 | 670 | 645 | 590 | 18.7 | 42 |
| 18 | 650 | 595 | 490 | 18.7 | 42 |
| Comparative Example 1 | 700 | 560 | 390 | 18.7 | 42 |
| Comparative Example 2 | 760 | 680 | 420 | 18.7 | 42 |
| Comparative Example 3 | 800 | 650 | 410 | 18.7 | 42 |

EXAMPLE 19

Figure 9:
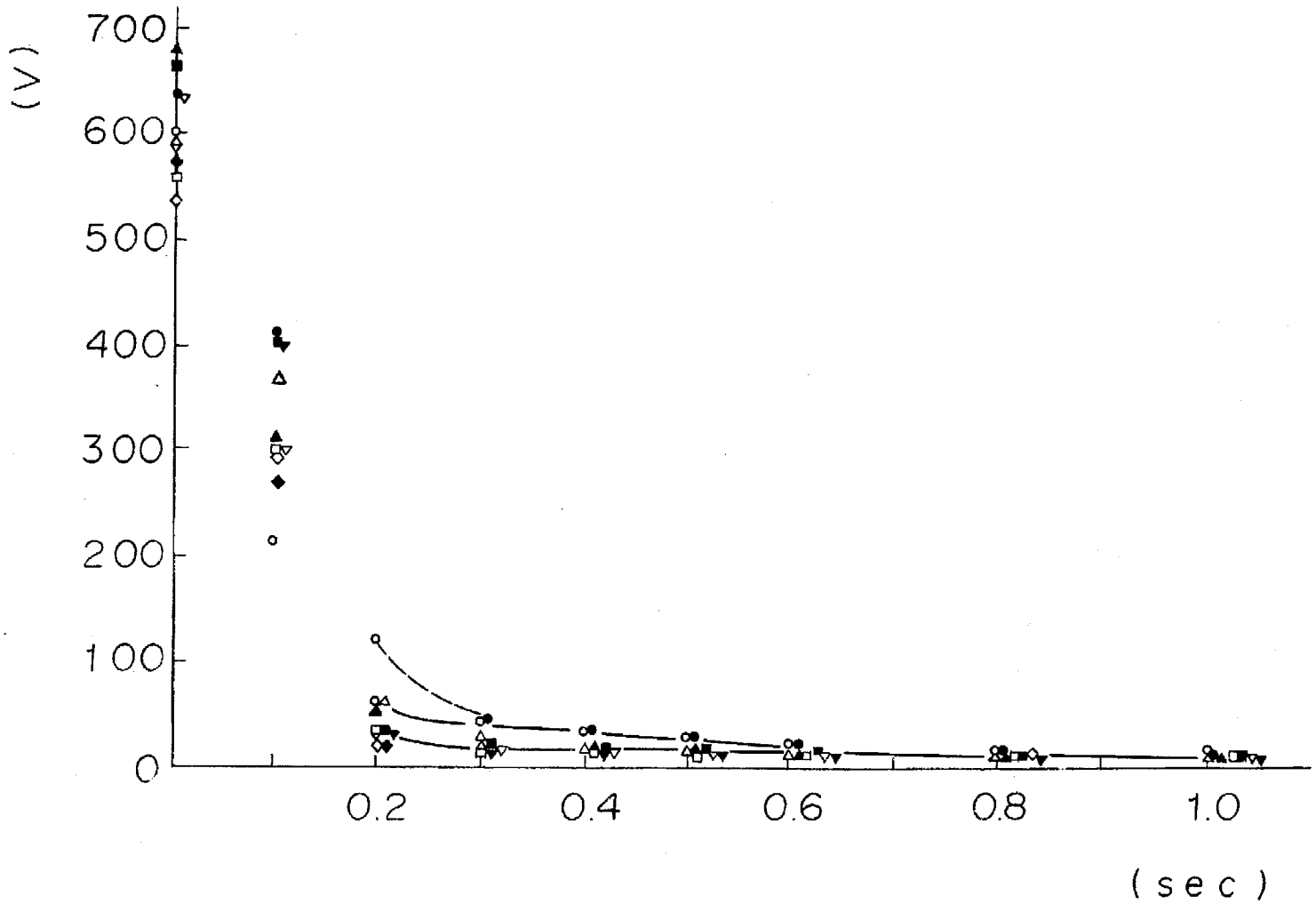
FIG. 9 is a graph plotting surface potential as a function of time from the initiation of exposure, illustrating light fatigue property according to one embodiment of the present invention.
Figure 10:
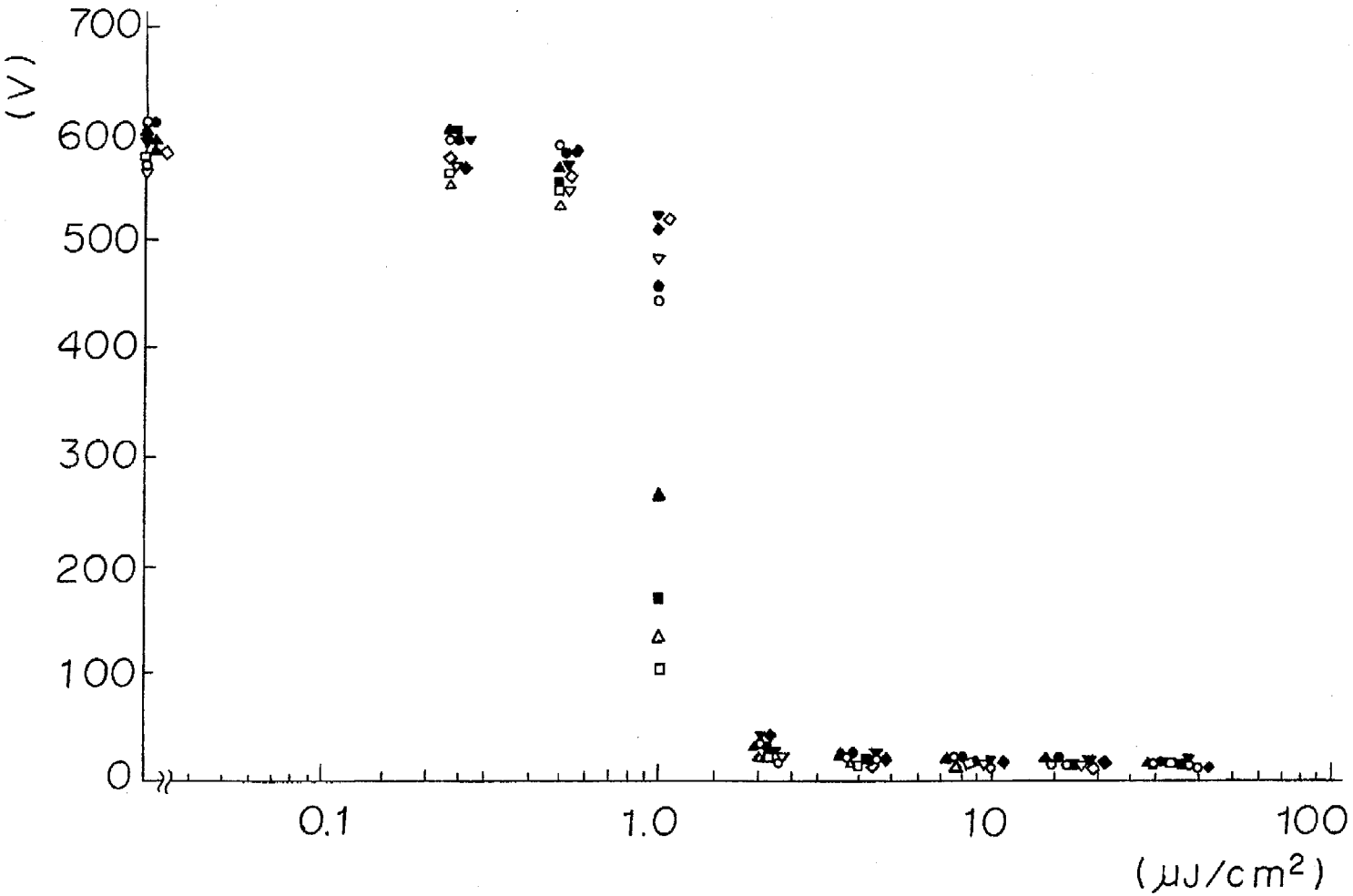
FIG. 10 is a graph plotting surface potential as a function of exposure amount, illustrating light fatigue property according to one embodiment of the present invention.

A photoconductive drum of 120 mmϕ was prepared by using the same materials and method as in Example 7, and the photoconductive drum thus prepared was evaluated under such conditions has disclosed in Table 5 with regard to the electrophotographic properties, i.e. charging property (FIG. 1), charge-retaining ability (FIG. 2), response speed (FIG. 3), spectrum sensitivity (FIG. 4), repeated charging property (FIG. 5), light decay property after repeating test (FIG. 6), environmental stability of dark decay property (FIG. 7), environmental stability of light decay property (FIG. 8) and light fatigue property (FIGS. 9 and 10). The results are shown in FIGS. 1 to 10.

TABLE 5

| | |
|---|---|
| Charging property (FIG. 1) | Temperature 26.1° C., Moisture 65% |
| Charging-retaining ability (FIG. 2) | Temperature 19.4° C., Moisture 78% |
| Response speed (FIG. 3) | Wavelength 780 nm, Exposure time 1/15 sec., Exposure amount 2 μj/cm$^2$ |
| Repeated charging property (FIG. 5) | Exposure 780 nm, 2 μJ/cm$^2$<br>Removal of electricity 650 nm, 4 μW/cm$^2$ × 1s = 4 μJ/cm$^2$<br>Since the measurement can not be conducted over 3,000 times per day, the measurement was conducted for 4 days. The marks, ·, ○, Δ and X respectively show the measurement results of the 1st, 2nd, 3rd and 4th day. |
| Light response property after repeated tests | Exposure 780 nm, 2 μJ/cm$^2$<br>Removal of electricity 650 nm, 4 μW/cm$^2$ × 1s = 4 μJ/cm$^2$ |

TABLE 5-continued

| | |
|---|---|
| (FIG. 6) | |
| Light fatigue property (FIG. 9) | Allowed to stand in a room of 700 lux |
| Light fatigue property (FIG. 10 | Charging +5.0 μA |

As evident from the results of FIGS. 1 to 10, it is clear that the positive charge type organic photoconductor of the present invention is practically excellent.

As mentioned above, the positive charge type organic photoconductor of the present invention uses a phthalocyanine type compound excellent in light absorbance, heat resistance, chemical resistance and light resistance and also excellent in production efficiency of electron.hole pair, and has an excellent ozone resistance.

We claim:

1. A positive charge type organic photoconductive layer comprising:

a film containing 15% to 40% by weight of a χ type crystal of a metal-free phthalocyanine compound in a binder resin, said film having a thickness of from 10 μm to 30 μm; and a coating on said film, said coating being a reactive product of a mixture of a diglycidyl ether epoxy resin of bisphenol F and an amine compound.

2. The positive charge type organic photoconductive layer according to claim 1, wherein the χ type crystal of the metal-free phthalocyanine compound is contained in an amount from 25 to 35% by weight.

3. The positive charge type organic photoconductive layer according to claim 1, wherein the film has a thickness of from 15 to 25 μm.

4. A positive charge type organic photoconductive layer, comprising:

a film comprising a χ type crystal of a metal-free phthalocyanine compound in a binder resin; and a coating on the film, the coating being a reactive product of a mixture of a diglycidyl ether epoxy resin of bisphenol F and an amine compound.

5. The positive charge type organic photoconductor layer according to claim 4, wherein the diglycidyl ether epoxy resin of bisphenol F contains hydroxyl groups.

6. The positive charge type organic photoconductor layer according to claim 4, wherein the χ type crystal of the metal-free phthalocyanine compound comprises, by weight, from 25% to 35% of the film.

7. The positive charge type organic photoconductor layer according to claim 6, wherein the film thickness is 15 μm to 25 μm.

* * * * *